US005576681A

United States Patent [19]

Sander et al.

[11] Patent Number: 5,576,681

[45] Date of Patent: Nov. 19, 1996

[54] HIGH VOLTAGE TRANSFORMER

[75] Inventors: Hans-Werner Sander, Hanover; Wolfgang Reichow, Garbsen; Walter Goseberg, Hanover, all of Germany

[73] Assignee: Deutsche Thomson-Brandt GmbH, Villingen-Schweningen, Germany

[21] Appl. No.: 417,482

[22] Filed: Apr. 5, 1995

Related U.S. Application Data

[63] Continuation of Ser. No. 73,436, Jun. 9, 1993, abandoned.

[30] Foreign Application Priority Data

Dec. 10, 1990 [DE] Germany ..... 40 39 373.9
Dec. 3, 1991 [WO] WIPO ..... PCT/EP91/02285

[51] Int. Cl.[6] ..... H01F 27/30

[52] U.S. Cl. ..... 336/208; 336/185; 336/198

[58] Field of Search ..... 336/185, 198, 336/208

[56] References Cited

U.S. PATENT DOCUMENTS

| | | | |
|---|---|---|---|
| 3,665,288 | 5/1972 | Godawaski | 321/24 |
| 3,904,928 | 9/1975 | Sawada et al. | 315/410 |
| 4,091,349 | 5/1978 | Niederjohn et al. | 336/192 |
| 4,247,889 | 1/1981 | Riechmann | 363/126 |
| 4,388,568 | 6/1983 | Goseberg et al. | 315/411 |
| 4,623,754 | 11/1986 | Kikuchi et al. | 172/52 R |
| 5,225,803 | 7/1993 | Niegel et al. | 336/208 |

FOREIGN PATENT DOCUMENTS

| | | | |
|---|---|---|---|
| 0047497 | 3/1981 | European Pat. Off. | H01F 19/00 |
| 2606205 | 10/1987 | France | H04N 3/195 |

*Primary Examiner*—Laura Thomas
*Attorney, Agent, or Firm*—Joseph S. Tripoli; Eric P. Herrmann; Daniel E. Sragow

[57] ABSTRACT

A high voltage transformer for a television receiver includes a primary winding and a secondary winding. The secondary winding is compartmentalized and is separated from the primary winding by a space. The secondary winding has a plurality of partial windings which are arranged in cells of a compartmentalized coil form and are connected to one another by diodes. The partial windings are positioned and dimensioned with respect to the primary winding to cause substantially equal pulse voltages of like polarity to exist at the neighboring portions of the primary winding and the partial windings in the vicinity of the space, to substantially eliminate pulse electric fields in the space.

9 Claims, 1 Drawing Sheet

HIGH VOLTAGE TRANSFORMER

This is a continuation of application Ser. No. 08/073,436 filed on Jun. 9, 1993 now abandoned.

This is a continuation of PCT application PCT/EP91/02285 filed 3 December 1991 by Walter Goseberg, Wolfgang Reichow and Hans-Werner Sander and titled "HIGH-VOLTAGE TRANSFORMER".

The invention is directed to a high voltage transformer and particularly to such a transformer for use in a large color television picture tube. One type of such a transformer is described in DE-OS 35 14 308. Such transformers generate a high voltage for television receivers in the order of magnitude of 25 kV. For television receivers with larger picture tubes, for example, with an aspect ratio of 16:9 or a screen diagonal of 85 cm, greater high voltages in the order of magnitude of 35 kV are required. Transformers for such high voltages unavoidably result in increased power loss, thereby causing the build-up of heat to be greater and increasing the geometrical dimensions required for the dissipation of the heat.

It is an object of the invention to reduce the transformer power dissipation in high voltage color picture tubes.

An analysis of the types of losses which occur in a high voltage transformer will make the merits of the invention very apparent. A first type of loss is the ferrite losses through magnetic reversal of the core corresponding to the area formed by the hysteresis curve. Such losses can only be reduced by the use of better quality ferrite materials. A second type of loss consists of copper losses through the ohmic resistance of the wire and the skin (Kelvin) effect. A third type of loss consists of losses in the high voltage rectifier diodes, i.e. through the forward voltage and the on-state current, the off-state voltage and the off-state current, and the switching losses caused by switching between the blocked and the conducting states. A fourth type of loss consists of dielectric losses through displacement currents in the insulator generally made from a sealing resin. As far as the first three types of loss are concerned, there are lower limits caused by, in particular, technological reasons and the available components. The invention now concentrates on the fourth type of loss i.e. the dielectric losses. The invention is based on the fact that the dielectric losses appear especially in the region between the primary winding and the secondary, or high voltage, winding because it is here that the greatest voltage difference exist. Therefore constructing this region to be as free from electrical fields as possible, the dielectric losses can be considerably reduced. With the invention, this is achieved by a particularly advantageous division of the pulse voltages at the primary winding and the secondary winding in such a way that in this region the pulses have roughly the same amplitude and polarity at the primary winding and at the secondary winding. The difference between the pulse voltages in the two windings is then practically zero and a space which is free from electric fields results and losses through dielectric displacement currents area avoided as far as possible. A significant advantage is that the field-free space is achieved by a skillful arrangement of parts that are required for other purposes rather than through the use of additional parts. Furthermore, by reducing the dielectric displacement currents in the insulator surrounding the windings, the harmonic content of the voltages generated is reduced. This leads to less natural resonances which otherwise are caused by displacement currents. The reduction in the harmonic waves causes an improvement to the internal resistance and, in addition, a reduction of the acoustic noise appearing at the transformer.

Further, the material surrounding the windings, preferably a cast resin, is also placed under less stress.

The invention is described with reference to the drawings in which.

In the following description only the pulses voltages effective at the transformer are taken into consideration. The direct voltages which appear are not considered because these cause no dielectric displacement currents and, consequently, no power losses.

Figure 1:
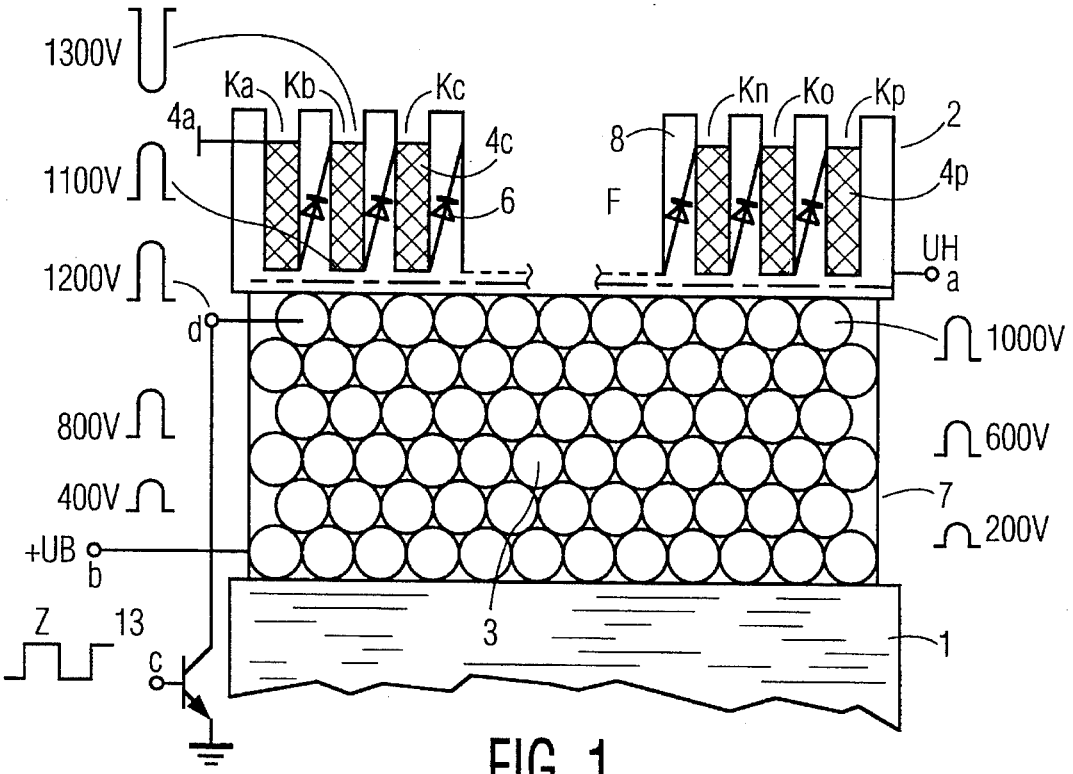
FIG. 1 is a preferred embodiment of a high voltage transformer.

In FIG. 1, a coil former 7 which supports a primary winding 3, is supported on a core 1. The primary winding 3 consists of six layers. The lead-in wire to the lower layer is connected by the terminal 'b' to the operating voltage +UB. The lead-out wire from the upper layer is connected to the terminal 'd' and to the switching transistor 13 which is controlled by a line-frequency switching voltage Z at terminal 'c'. The pulse voltage at terminal 'b' is zero. The pulse voltage at terminal 'd' has the full value of the flyback voltage, i.e. +1200 V. Therefore, the pulse voltage continually increases, from winding to winding, from the value zero at terminal 'b' up to the maximum value at terminal 'd'. This means that the pulse voltage decreases by about 16 per cent over the axial length of the upper layer of the winding 3 and the pulse voltage at the right-hand end of the upper layer has a value of +1000 V. The pulse voltage is, therefore, essentially constant over the axial length of the coil former 7 in the upper layer of winding 3 and has a mean value of 1100 V.

Arranged above the coil former 7 with the primary winding 3 is the compartmentalized coil former 2 which has a total of 16 compartments, or cells, Ka through Kp , separated by walls 8. The cells are filled with partial windings 4*a* through 4*p* of the secondary, or high voltage, winding 4. The lead wire from the upper layer of the first partial winding 4*a* is connected to ground. Each of the lead wires at the base of a cell K is coupled to the anode of a high voltage rectifier diode 6, the cathodes of which are coupled to the lead wire from the upper end of the succeeding partial winding 4. The lead wire from the base of the final partial winding 4*p* in cell Kp forms the high voltage terminal 'a'. The winding process for the entire secondary winding 4 starts at the base of cell Kp. Because one diode 6 is positioned between each pair of cells, fifteen of the diodes 6 are provided for a total of sixteen of the cells K. A high voltage UH of 32 kV ensues at terminal 'a'. These values assume the pulse of +1100 V results at the base of each cell K, and is identical for all cells. A pulse of 1300 V results at the upper end of winding 4.

Consequently, pulses with an essentially constant amplitude of +1100 V are present along the upper layer of winding 3. On the other hand, as described above, pulses with the constant amplitude of +1200 V also ensue through the high voltage winding 4 in the region associated with the winding 3, i.e. in the region of the lower ends of the cells. Apart from that, the pulses at winding 3 and at winding 4 are isochronous. Therefore, practically no voltage difference exists between the pulses at winding 3 and the pulses at winding 4 so that a space which is free from electric fields results, as indicated by the dotted line F.

The pulses at the upper end of the windings 4 have the wrong polarity for creating a field-free space. However, the pulses present at this point are sufficiently distant from the primary winding 3 that they do not cause any significant displacement currents through the insulator.

The upper end of the first winding 4*a* is connected to ground and therefore conducts no pulse voltage while, on the other hand, the lower end of the final winding 4*p*, which is connected to ground via the capacitance of the picture tube, also conducts no pulse voltage. The voltage ratios of these two windings are, therefore, different with respect to those of the other windings 4*b* through 4*o*. In order to produce the desired amplitude ratios between the pulse voltages in this region, it is advantageous to, in contrast to the remaining cells, only half fill the cells Ka and Kp. The primary winding 3 is preferably wound from stranded conductor in order to keep the losses due to the skin effect low.

Figure 2:
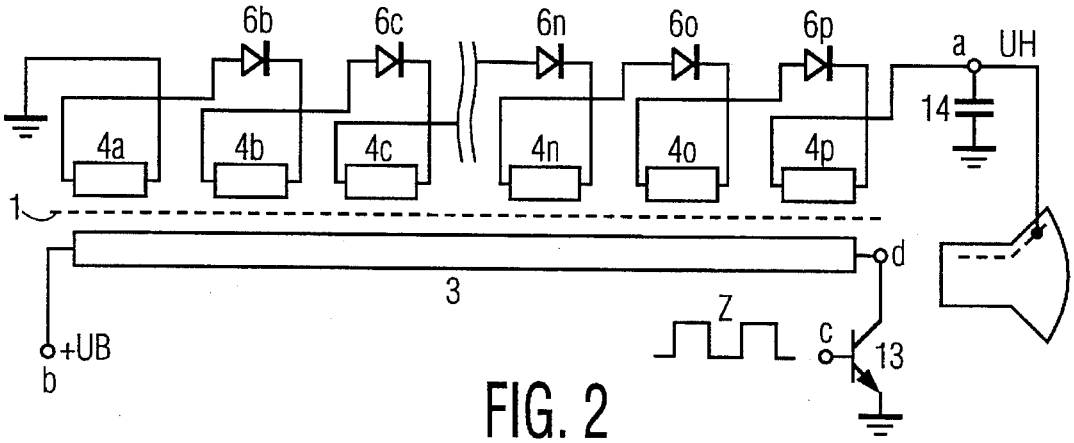
FIG. 2 shows an equivalent circuit for the transformer according to FIG. 1.

FIG. 2 shows the replacement circuit diagram associated with FIG. 1. The capacitor 14, essentially formed by the anode terminal of picture tube 15, is connected to terminal 'a', which is the output terminal for the high voltage UH. The diode 6*b* therefore corresponds to the first diode in FIG. 1 between the base of cell Ka and the lead-out wire at the upper end of cell Kb. The final diode 6*p* corresponds to the diode between the lower end of the winding of cell Ko and the upper lead-out wire of the final cell Kp.

It is also possible to sub-divide the primary winding 3 into several partial windings which lie adjacent each other in the axial direction on the core 1 and are wired in parallel between the terminals 'b' and 'd'. Generally, the amplitude at the upper layer of primary winding 3 varies over the axial length. This can be taken into account in that the cells Ka through Kp are filled accordingly differently so that the pulses of each of the partial windings 4*a* through 4*p* also have correspondingly differing amplitudes at the bases of the cells. The filling factor for the cells K with the partial windings 4 would then decrease from the left-to the right-hand end of the coil formers 7, 2, in the same way as the amplitude of the pulses at the upper layer of winding 3 decreases, front, in FIG. 1, +1200 V to +1000 V.

We claim:

1. A high voltage transformer for a television receiver comprising:

a primary winding;

a compartmentalized secondary winding separated from said primary winding by a space, said secondary winding having a plurality of partial windings arranged in cells of a compartmentalized coil form and connected to one another by diodes, and means for causing substantially equal pulse voltages of like polarity to exist at said primary winding and said partial windings in the vicinity of said space, to substantially eliminate pulse electric fields in said space.

2. The transformer of claim 1 wherein said primary winding is wound in layers with several layers lying above each other, and wherein a lead-in wire is provided to a lowest layer for connecting to an operating voltage and a lead-out wire is connected to an upper layer for connecting to a periodic switch.

3. the transformer of claim 2 wherein said partial windings are polarized to provide a positive-directed pulse at said lead-out wire.

4. The transformer of claim 3 wherein the number and dimensions of said partial windings is selected to be sufficiently large to provide a positive pulse at the base of a cell which has substantially the same amplitude as a positive-directed pulse at the upper layer of said primary winding.

5. The transformer of claim 2 wherein the anode of one diode is connected to the lead wire from the base of a cell and the cathode of each said diodes is connected to the lead wire from the upper layer of the partial winding of the next cell.

6. The transformer of claim 2 wherein the start of said secondary winnding is the output terminal for supplying a high voltage to said television receiver.

7. The transformer of claim 2 wherein said transformer is a split transformer utilizing diodes.

8. The transformer of claim 2 wherein said cells are filled by said partial windings whereby the pulses at the base of each of said cells have substantially the same amplitude as the pulses at the neighboring winding of said primary winding.

9. The transformer of claim 2 wherein the first and the second of said cells are filled less the the rest of said cells.

* * * * *